US005884860A

United States Patent [19]

Ishikawa et al.

[11] Patent Number: 5,884,860

[45] Date of Patent: Mar. 23, 1999

[54] ROLLED PAPER FEEDING APPARATUS WHICH PROVIDES A CONSTANT TORQUE FOR UNCURLING PAPER AND A TORQUE LIMITING DEVICE THEREFOR

[75] Inventors: Kazumasa Ishikawa, Kawasaki; Akihiro Fujita, Isehara, both of Japan

[73] Assignee: Ricoh Company, Ltd., Tokyo, Japan

[21] Appl. No.: 753,767

[22] Filed: Nov. 29, 1996

[30] Foreign Application Priority Data

Mar. 19, 1996 [JP] Japan ..... 8-090465
Apr. 12, 1996 [JP] Japan ..... 8-090672

[51] Int. Cl.[6] ..... B65H 23/06

[52] U.S. Cl. ..... 242/422; 242/422.4

[58] Field of Search ..... 242/422, 422.2, 242/422.3, 422.4, 422.9, 423, 423.1, 423.2, 615, 615.2, 566, 422.1

[56] References Cited

U.S. PATENT DOCUMENTS

| | | | |
|---|---|---|---|
| 477,580 | 6/1892 | Sentman | 242/422.1 |
| 1,619,574 | 3/1927 | Horton | 242/422.9 |
| 2,658,693 | 11/1953 | Wolf | 242/422.2 |
| 2,666,597 | 1/1954 | Wood | 242/422.1 |
| 2,714,996 | 8/1955 | Stroehman | 242/422.4 |
| 3,380,679 | 4/1968 | Komas et al. | 242/422 |
| 3,405,791 | 10/1968 | Kaplan | 242/422.4 |
| 3,450,365 | 6/1969 | Kaplan | 242/422.4 |
| 3,604,652 | 9/1971 | Sleeper | 242/615.1 |
| 3,721,394 | 3/1973 | Reiser | 242/422.2 |
| 3,729,123 | 4/1973 | Lloyd | 242/422.4 |
| 3,734,424 | 5/1973 | Ulseth | 242/422.9 |
| 4,356,983 | 11/1982 | Weiss | 242/422.2 |
| 4,610,407 | 9/1986 | Stubbmann | 242/422.4 |
| 5,224,662 | 7/1993 | Kaussen | 242/422.4 |
| 5,297,750 | 3/1994 | Hunt | 242/422.4 |
| 5,566,906 | 10/1996 | Kamada et al. | 242/615 |
| 5,667,164 | 9/1997 | Yamamoto | 242/422 |

FOREIGN PATENT DOCUMENTS 7-309491 11/1995 Japan .

*Primary Examiner*—John M. Jillions
*Attorney, Agent, or Firm*—Oblon, Spivak, McClelland, Maier & Neustadt, P.C.

[57] ABSTRACT

An image forming apparatus which uses rolled paper pulls the paper around a decurling roller in order to straighten the paper to allow the paper to remain flat. One or more torque limiting devices which provides a constant angular force against the unrolling of the paper is utilized to provide a force which straightens out or decurls the rolled paper which increases as the radius of the roll of paper decreases. The torque limiting device can be implemented using a spring which grips a rotating cylindrical surface as the surface rotates, a viscous-elastic fluid which provides a resistance against rotation, frictional surfaces, or magnets. The torque limiting device may also be implemented using two springs which provide different resistance against rotation in order to provide different rotational resistance, depending on the direction the roll of paper is rotating.

14 Claims, 11 Drawing Sheets

ROLLED PAPER FEEDING APPARATUS WHICH PROVIDES A CONSTANT TORQUE FOR UNCURLING PAPER AND A TORQUE LIMITING DEVICE THEREFOR

CROSS REFERENCES TO RELATED APPLICATIONS

This application claims priority to Japanese Patent Applications 8-90465 filed Mar. 19, 1996 and 8-90672 filed Apr. 12, 1996, both of which are incorporated herein by reference.

BACKGROUND OF THE INVENTION

1. Field of the Invention

The present invention is directed to a rolled paper feeding apparatus used in an image forming apparatus such as a facsimile machine, printer, digital copier, and the like. More particularly, the present invention is directed to an apparatus for providing resistance against the feeding out of paper in order to uncurl the rolled paper. The present invention is further directed towards a torque limiting device for providing a constant angular force (torque) which is used for unrolling the paper.

2. Discussion of the Background

FIG. 1A illustrates a conventional facsimile device 100 which utilizes rolled paper 1. The rolled paper 1 which will have an image recorded thereon is set into a receiving bin in the direction of arrow 'A'. In the device 100, the paper is not supported in any manner at the rotational axis but rests on the bottom of the paper bin. Therefore, there is no need to use any type of paper spool or collar with the paper 1 in the facsimile machine 100.

FIG. 1B illustrates a different type of rolled paper facsimile machine which utilizes a paper spool 2 or support device made up of a shaft 2*a* and a side plate 2*b*. The rolled paper 1 with the spool is used to allow the paper to be smoothly pulled off of the roll as the roll of paper 1 is rotating. The support 2 may be referred to as a spool, spindle, spur, or other device which supports the rolled paper 1 as the roll is rotating. In FIG. 1B, the supports 2 are pushed against the roll of paper in the direction of the arrows 'B' and the rolled paper 1 having the two supports 2 is inserted into the facsimile machine 102 in the direction of arrow 'C'. In FIG. 1B, the shaft 2*a* may freely rotate with respect to the side plate 2*b*, or alternatively, the shaft 2*a*may be fixed to the side plate 2*b* and therefore, the side plate 2*b* will rotate inside of the facsimile machine 102.

FIG. 2 is a cross-sectional view of the roll of paper 1 which includes a plurality of layers of paper 1*a* and a cardboard core 1*b*. In FIG. 2, a collar 3 is tightly inserted into the cardboard core 1*b* and the shaft 2*a* of the support device is inserted into the collar 3. The collar 3 is fixed with respect to the cardboard core 1*b* of the rolled paper 1 whereas the collar 3 and roll of paper 1 rotate freely with respect to the shaft 2*a* and the support 2.

FIG. 3 illustrates a conventional manner of uncurling the paper from the roll of paper 1. A pair of transport rollers 112 and 114 pull the paper around a decurling roller 110 so as to correct a curling of the paper in an opposite direction to a paper winding direction on the roll with a force of Fa. The rolled paper 1 provide a resistance against the force Fa in order to uncurl the paper around the decurling roller 110.

However, the decurling system illustrated in FIG. 3 has a drawback in that as the roll of paper uncurls, the paper must be under a higher tension around the decurling roller 110 to properly decurl the paper as the radius of the rolled paper 1 gets smaller. This is because the paper wound at a smaller radius (e.g., at a region closer to the core of the rolled paper) requires more tension to properly decurl the paper because the curl of the paper is smaller or tighter near the core. The frictional force imposed against the turning of the rolled paper 1 is partially dependent on the weight of the paper. As the weight of the rolled paper 1 becomes lighter, less force against the pulling of the paper in the direction Fa is imparted. Therefore, even as the radius of the rolled paper decreases which results in an increase in the force which prevents the unrolling operation, unsatisfactory force used for decurling may result due to the decrease in weight of the paper.

FIG. 4 illustrates three different relationships designated by the lines 'A', 'B' and 'C'. 'A' is the ideal curve which would achieve the optimum paper decurling. The curve 'A' shows an inverse linear relationship between the force Fa (in Newtons, for example) and the radius of the rolled paper (in centimeters). The line 'B' shows a first example of the force Fa of a conventional system. For example, the line 'B' can illustrate a roll of paper having a relatively small diameter core which is smooth. Also for example, the curve 'C' illustrates the force for a small diameter core of a roll of paper which is somewhat dented. It can be seen in FIG. 4 that the slope of the ideal line 'A' has the force increasing as the radius of the rolled paper decreases whereas neither lines 'B' nor 'C' have an increase in force as the radius of the rolled paper decreases.

SUMMARY OF THE INVENTION

Accordingly, it is an object of the invention to provide an image forming apparatus which uses rolled paper which is able to properly and consistently decurl the paper. It is a further object of the invention to utilize a torque limiting device which provides a constant torque (angular force) against the unrolling of the paper to achieve a smoothly varying decurling force which increases as the radius of the rolled paper decreases. It is a further object of the invention to provide a torque limiting device which provides different angular forces, depending on the direction in which the torque limiting device is rotated.

These and other objects are provided by an image forming device which uses rolled paper and has a torque limiting device which provides a constant angular resistance force (torque) against the unrolling of the paper. This force is not dependent on the weight of the paper on the paper roll. As the paper is used from the paper roll and the radius of the rolled paper decreases, the force needed to unroll the paper becomes larger. The larger force needed to unroll the paper results in a larger force around the decurling roller. The larger force around the decurling roller results in a greater decurling of the paper which is needed as the radius of the paper roll becomes smaller. The torque limiting device may be used at only one or alternatively both ends of the support devices which rotationally supports the roll of paper.

The torque limiting device may be implemented by a spring torque limiter in which a spring is wound around a circular shaft and grips the shaft when the shaft is rotated in a first direction and does not tightly grip the shaft when the shaft is rotated in a second direction. Alternatively, the torque limiter may be implemented using a viscous-elastic material such as silicon oil which provides a resistance to rotation. As a further implementation, the torque limiter may be implemented using a frictional resistance between two surfaces which are perpendicular to an axis of rotation.

Alternatively, the frictional surfaces may be cylindrical in shape and surround the axis of rotation. As still another alternative, the torque limiting device may be implemented using magnets.

In the preferred embodiment of the invention, the torque limiting device is implemented using two springs. This torque limiter is cylindrical in nature and includes a first rotational part, a second rotational part, and a cylindrical housing. When the two spring torque limiter is providing the resistance utilized to decurl the paper, the first spring which couples the first and second rotational parts completely locks the first and second rotational parts to each other. The second spring provides a relatively strong coupling action of the second rotational part to the housing. Therefore, the torque limiter provides a strong coupling force between the first rotational part and the housing, thereby providing a relatively strong torque such as 160 gram force·cm.

In a second mode of operation, the torque limiter provides a relatively light resistance which is used to provide a slight resistance to the paper being manually wound back on to the roll during the procedure of installing the paper into the image forming apparatus. In this mode of operation, the second spring is tightly wound so that the second rotational part is fixed to or does not rotate with respect to the housing. However, the first spring provides a relatively small resistance between the relative rotation of the first spring and the second spring. The net result of the operation of the torque limiter in this mode is that the first rotational part is permitted to rotate with a small amount of resistance with respect to the second rotational part which is locked to the housing.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1A:
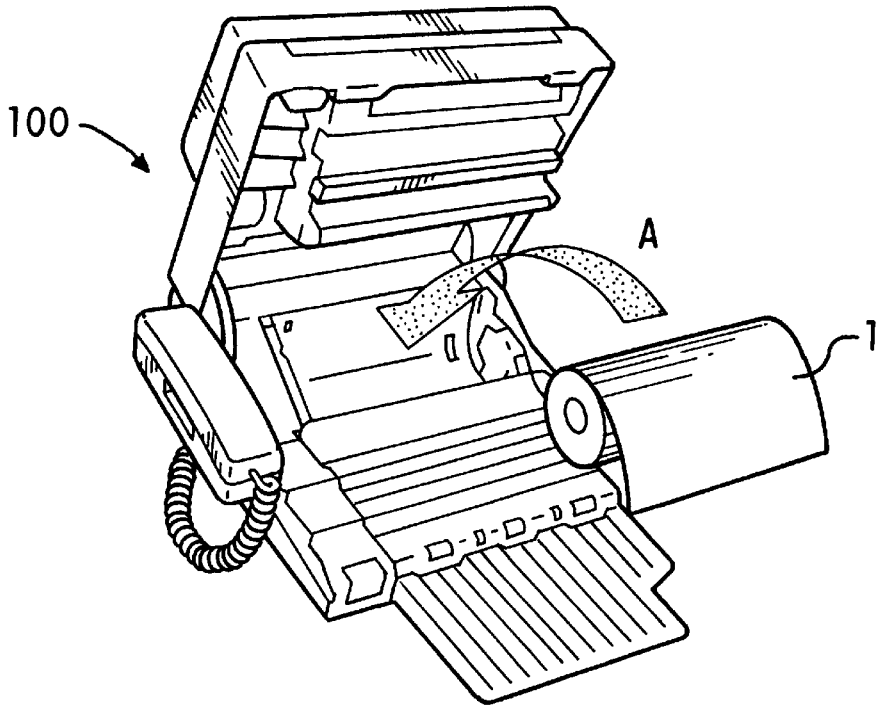
FIG. 1A RELATED ART
FIG. 1A illustrates a conventional facsimile machine in which a roll of paper rotates without being supported at the axis of rotation of the roll of paper.
Figure 1B:
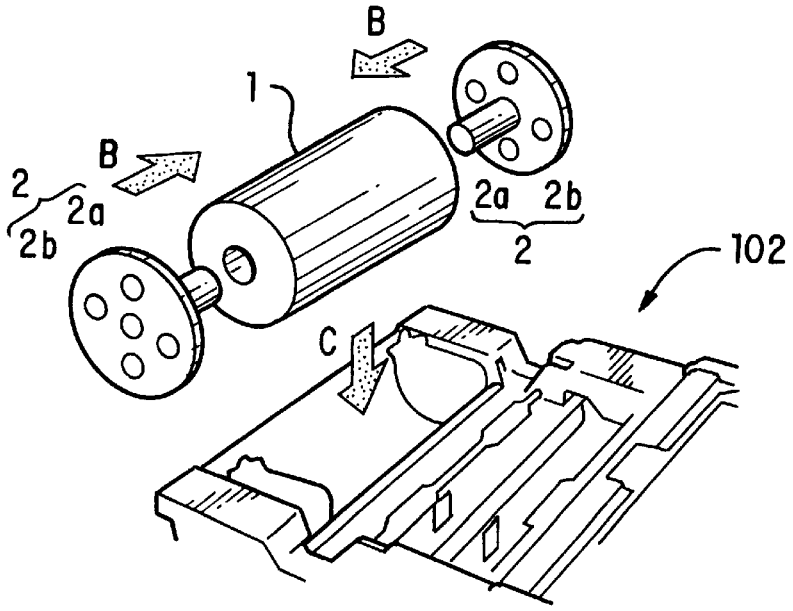
FIG. 1B RELATED ART
FIG. 1B illustrates another conventional image forming apparatus in which the roll of paper is rotationally supported at its axis of rotation.
Figure 2:
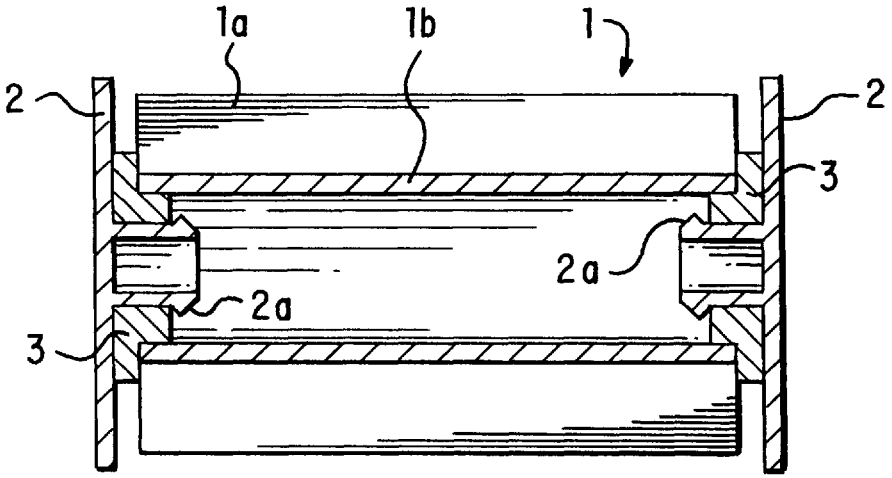
FIG. 2 RELATED ART
FIG. 2 illustrates a conventional manner of supporting a roll of paper at its rotational axis.
Figure 3:
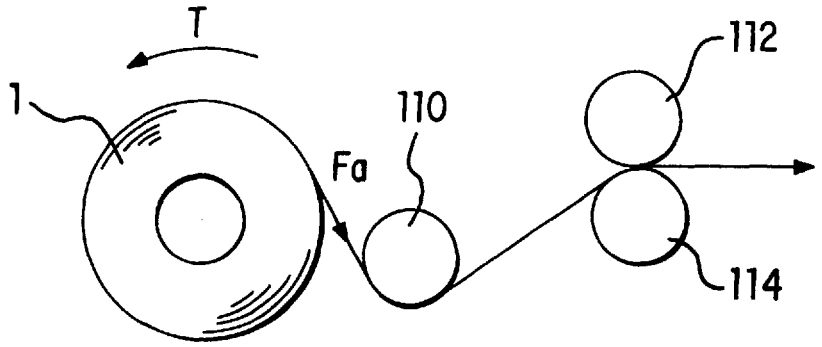
FIG. 3 RELATED ART
FIG. 3 illustrates a conventional manner of decurling rolled paper using a decurling roller.
Figure 4:
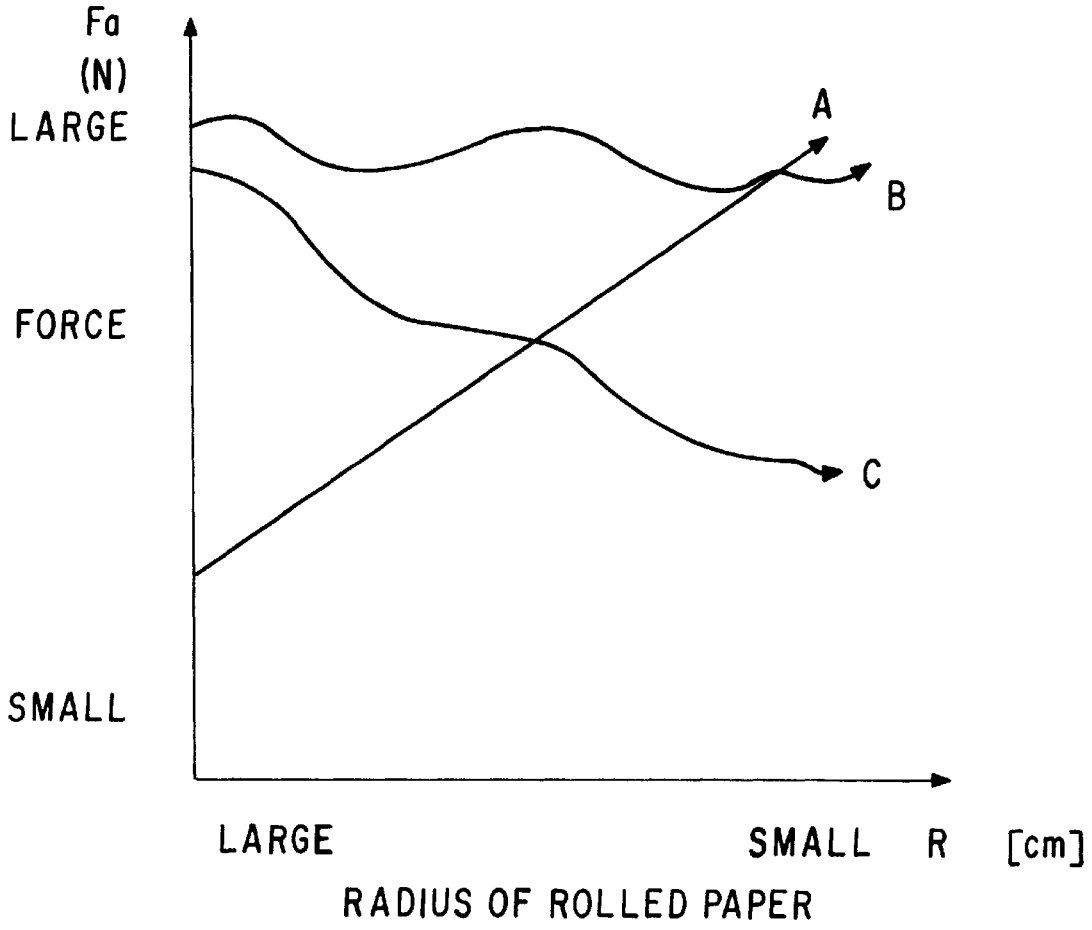
FIG. 4 illustrates the desired force Fa used to decurl paper in a curve 'A' and the curves 'B' and 'C' illustrate estimated forces used to decurl paper in conventional image forming apparatuses.
Figure 5:
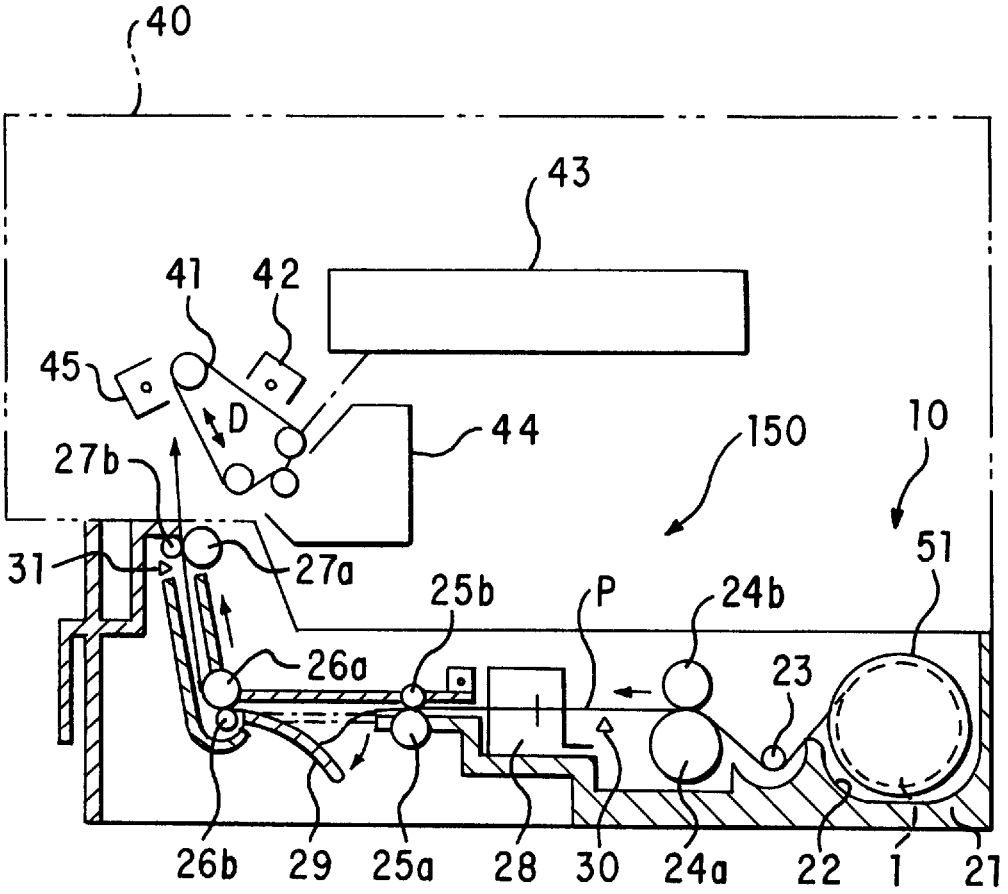
FIG. 5 illustrates an image forming apparatus such as a facsimile machine which operates in accordance with the teachings of the present invention.

Referring now to the drawings, wherein like reference numerals designate identical or corresponding parts throughout the several views, and more particularly to FIG. 5 thereof, there is illustrated an image forming apparatus such as a facsimile machine, printer, copier, digital printer, multi-function machine, or any other device which uses rolled paper. The image forming apparatus of FIG. 5 includes an image forming section 40 for forming an image on recording paper P fed therein, and a paper feeding section 150 for providing the recording paper P to the image forming section 40 while pulling out the recording paper P from a roll of recording paper 1 wound up on a roll and cutting the paper to a predetermined length.

The paper feeding section 150 is provided within a cassette base 21 removably attached to the lower side of the image forming apparatus body and includes a cassette holder 22, a decurling roller 23, pick-up rollers 24*a* and 24*b*, feed rollers 25*a* and 25*b*, relay rollers 26*a* and 26*b*, registration rollers 27*a* and 27*b*, a cutter or cutting part 28, a flexible guide member 29 made of mylar, for example, a paper end detection sensor 30, a passing paper detection 31, and a recording paper storage section 10 which holds the roll of paper 1.

The cassette holder 22 contains the recording paper storage section 10 between cassette holder sidewalls 21 on each side of the image forming apparatus. The pick-up rollers 24*a* and 24*b* pull the paper off of the roll with a predetermined pull-out force in order to pull the recording paper P from the roll of paper 1. As the paper is pulled by the pick-up rollers 24*a* and 24*b*, the decurling roller 23 which functions as a decurling means and is arranged between the pick-up rollers 24*a* and 24*b* and the roll of recording paper 1 decurls the paper. The recording paper P pulled from the roll of recording paper 1 is wound on to the decurling roller 3 in a direction opposite to the direction in which the recording paper P has been wound on the roll 1. This straightens or decurls the curl of the recording paper using the tension of the recording paper P. Since the ability of the decurling roller 23 to straighten or decurl the curl of the recording paper P is proportional to the tension or force of the recording paper P between the pick-up rollers 24*a*, 24*b* and the roll of recording paper 1, the capability of straightening the curl increases as the tension or force on the paper becomes larger. The tension is proportional to the pull-out force caused when the pick-up rollers 24*a*, 24*b* pull out the recording paper P from the roll of recording paper 1. The cutter or cutting part 28 is provided between the pick-up rollers 24*a*, 24*b* and the feed rollers 25*a*, 25*b* so that the recording paper P, the curl of which has been straightened by the decurling roller 23 can be cut to a predetermined length perpendicular to the transport direction of the recording paper P. The feed rollers 25*a*, 25*b*, the relay rollers 26*a*, 26*b*, and the registering rollers 27*a*, 27*b* then carry the cut recording paper P to the image forming section 40. The flexible guide member 29 made of mylar is arranged between the feed rollers 25*a*, 25*b* and the relay rollers 26*a*, 26*b*. When extra recording paper is pulled out together with the recording paper P in the process of transporting the recording paper P, the flexible guide member 29 functions to adjust the condition of the recording paper P such as the feed rate of the recording paper P to be carried from the feed rollers 25*a*, 25*b* to the image forming section 40 by bending the extra recording paper downwardly. The paper and detection sensor 30 is provided at a downstream side of the pick-up rollers 24 for detecting the end of the recording paper P. The passing paper detection sensor 31 is provided on the upstream side of the registration rollers 27 for detecting the recording paper P passing therethrough.

The pick-up rollers 24*a*, 24*b*, the feed rollers 25*a*, 25*b*, the relay rollers 26*a*, 26*b*, and the registration rollers 27*a*, 27*b*, to which a motor (not illustrated) provides rotational motion constitutes a carrying means for pulling out the leading edge of the recording paper from the roll of recording paper 1 and carrying the recording paper in a predetermined direction. The rotational speed of the relay rollers 26 is made slower than the other rollers 24, 25, and 27 by adjusting the torque applied thereto which is transmitted from the motor, or alternatively using different gearing.

The image forming section 40 includes a photoconductor belt 41 which is driven in a direction indicated by the arrow 'D'. A charger 42 uniformly charges the surface of a photoconductive belt 41. Alternatively, the photoconductive belt 41 can be implemented using a photoconductive roller or any other type of photoconductive surface. An optical rider 43 which includes, for example, a laser beam generating device and a rotating polygolonal mirror or alternatively includes an array of LEDs writes image information onto the photoconductive belt 41 to form an electrostatic latent image. A developer 44 develops the electrostatic latent image formed on the photoconductive belt 41 to form a visible toner image, and a transfer charger 45 transfers the visible image from the photoconductive belt 41 to the recording paper P. The recording paper P is finally ejected to an exterior of the image forming device after fusing the toner image to the recording paper P. The image recording section 40 is arranged downstream in the carrying direction from the decurling roller 23.

Figure 6:
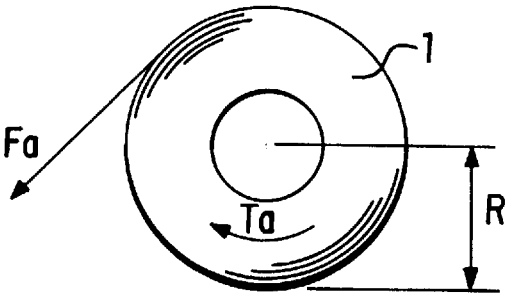
FIG. 6 illustrates a roll of paper in the forces which are involved during the decurling process.

FIG. 6 is a cross-sectional view of the roll of paper 1 and is utilized to explain the forces used to decurl the paper. The force Fa at which the paper is pulled off of the roll 1, also referred to as the back tension, is equal to the torque, also referred to as a rotational load or angular force, used to resist the unrolling of the paper divided by the radius r of the roll of paper as indicated by the following formula.

$$Fa=Ta/r \tag{1}$$

In the preferred embodiment of the invention, a torque limiting device imposing 160 gram force·cm is utilized at each end of the roll of paper (e.g., two torque limiting devices are used), thereby imposing a total of 320gram force·cm which is equal to Ta. Also in the preferred embodiment of the invention, the maximum radius of the roll of paper is 5 cm and the minimum radius of the roll of paper, that is the radius of the outer cardboard tube1 1*b* of the roll of paper 1 is 2 cm. As is evident from equation (1), as the radius r of the rolled paper decreases, the back tension Fa increases. The torque Ta is preferably constant, or made as constant as possible, thus being substantially constant. As the radius of the roll of paper decreases, a higher back tension force Fa is needed in order to properly decurl the paper which was pulled from the inner portion of the roll 1 and this increased back tension is in fact provided by the present invention because as r decreases, Fa increases.

Figure 7A:
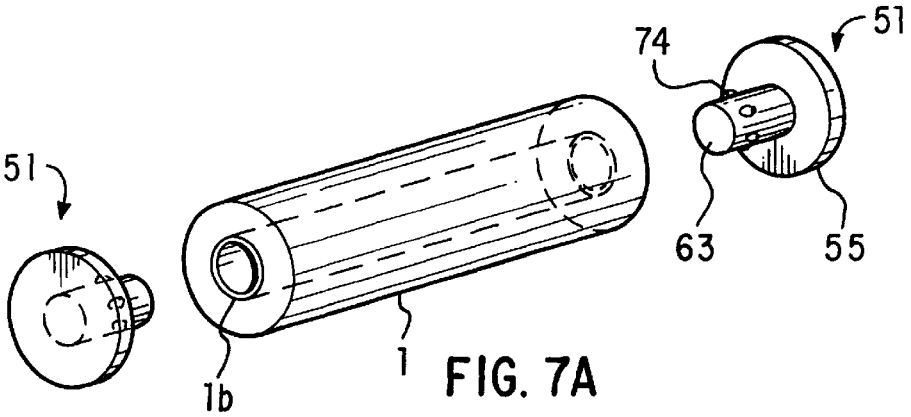
FIG. 7A illustrates projections utilized on the shafts of support devices which are used to lock the roll of paper to the shaft.
Figure 7B:
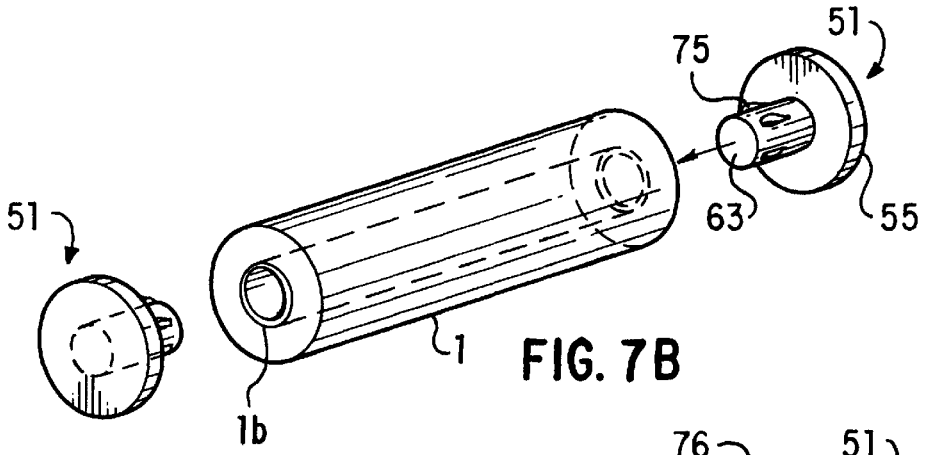
FIG. 7B illustrates plate springs utilized on or in the shafts of the support devices in order to lock the roll of paper to the shafts.
Figure 7C:
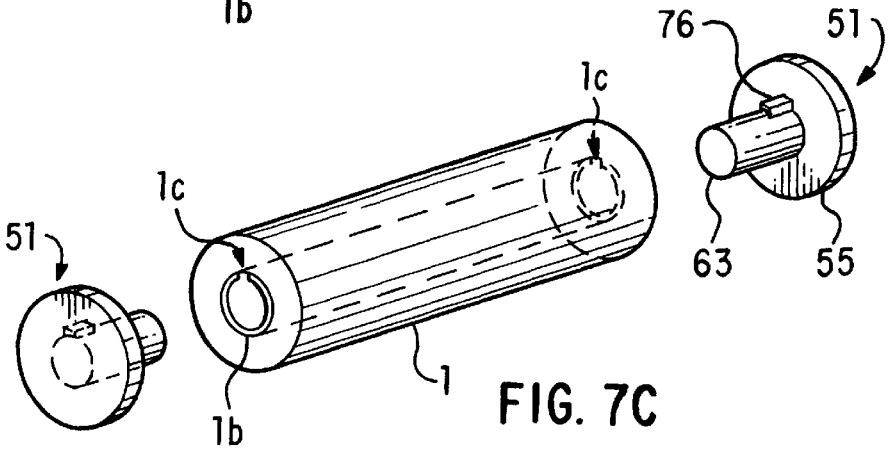
FIG. 7C illustrates key projections which are inserted into a key groove in a roll of paper in order to prevent relative rotation between the shafts of the support devices and the roll of paper.

In order for the present invention to properly provide the back tension Fa, it is necessary for the roll of paper to have no or minimal slipping when mounted to a shaft of a support device. FIG. 7A–7C illustrate three exemplary manners of mounting the roll of paper 1 to the support devices. In FIG. 7A, there are illustrated two support devices 51, also referred to as paper spools, spurs, or the like, which rotationally support the roll of paper 1. Each support device 51 has a shaft 63 which rotates with respect to a side plate 55 with a constant torque or angular resistance which is determined by a torque limiting device contained within the shaft 63. As an alternative to the shaft 63 rotating relative to the side plate 55, the shaft 63 may be fixed to the side plate 55 and a resistance device may be utilized which provides a resistance against the rotation of the side plate 55.

In the embodiment of FIG. 7A, the shaft has protrusions or projections 74 thereon which frictionally engage with the interior of a cardboard tube 1*b* which supports the roll of paper 1. These projections 74 prevent the rotation of the shaft 63 relative to the roll of paper 1. FIG. 7B illustrates an alternative embodiment which uses plate springs 75 which engage with the interior surface of the cardboard tube 1*b* in order to prevent relative rotation between the roll 1*b* and the shaft 63. Details of this embodiment are set forth in FIGS. 10, 11 and 12 explained below.

As an alternative to FIG. 7A and 7B, the shaft 63 of the support device 51 includes one or more key projections 76. These projections are inserted into a key groove 1*c* contained in the cardboard tube 1*b* which supports the roll of paper 1. It is to be noted that the tube 1*b* can be implemented using any other desired material such as a heavy paper or plastic, for example.

Figure 8A:
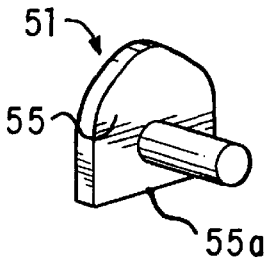
FIGS. 8A and 8B illustrate two different support devices which have a flat bottom in order to prevent rotation of the side plate of the support device.
Figure 8B:
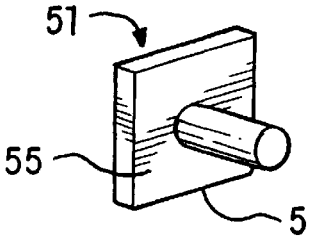

In the preferred embodiment of the invention, it is necessary to prevent the side plates 55 of the support device 51 from rotating with respect to the rotational motion of the shafts 63. The fixing of the side plate 55 to the image forming apparatus may be performed in any desired manner such as by frictionally engaging the side plates 55 within the image forming apparatus or placing tabs or protrusions on the side plates 55 which engage with a paper tray or bin. In the preferred embodiment of the invention, the side plates 55 are constructed in a manner illustrated in FIG. 8A. In this diagram, one surface such as the bottom surface 55*a* of the side plate 55 is flat. This flat edge 55*a*, preferably on which the support device 51 rests, prevents the rotation of the side plate 55. A top portion of the side plate 55 may be round in shape and have a radius similar to a maximum radius of the roll of paper. As an alternative to the construction of FIG. 8A, the side plate 55 may be constructed as a square or other rectangular shape, as illustrated in FIG. 8B. As in FIG. 8A, the flat surface 55*a* prevents the side plate 55 from rotating.

Figure 9A:
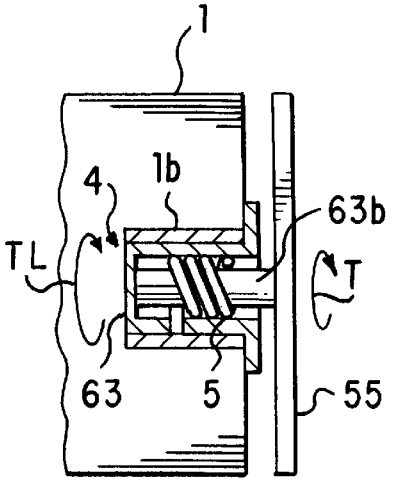
FIG. 9A illustrates a torque limiting device which utilizes a spring to impart a frictional resistance.

FIGS. 9A–9E illustrate five exemplary implementations of a torque limiter 4 used to provide a rotational resistance or force which prevents the side plate 55 from rotating freely with respect to the roll of paper 1, but does allow the side plate 55 to rotate with respect to the roll of paper 1 with some resistance. In FIG. 9A, a shaft 63 including a torque limiting device 4 therein contains a spring 5, the spring 5 being fixed to the shaft 63, also referred to as a collar. Fixed to the side plate 55 is an inner shaft 63*b* which remains fixed (not rotating) as the side plate 55 remains fixed (and rotates as the side plate 55 rotates). When the spring 5 rotates in one direction because of a rotation of paper on the roll of paper being pulled out, (either a clockwise or counter-clockwise direction) the spring 5 tightens around the shaft 63 which causes the torque Ta which is a constant angular force between the inner shaft 63*b* (and therefore the side plate 55) and the outer shaft 63. When the roll of paper rotates in the other direction, the spring loosens, providing no or a smaller force than when the inner shaft 63 and side plate rotate in the other direction with respect to the outer shaft 63. The rotational force TL which results when the paper is pulled off of the roll 1 is resisted by a force T due to the torque limiter 4. The force T is less than TL, thus allowing the roll of paper 1 to rotate and the paper to be pulled off of the roll.

Figure 9B:
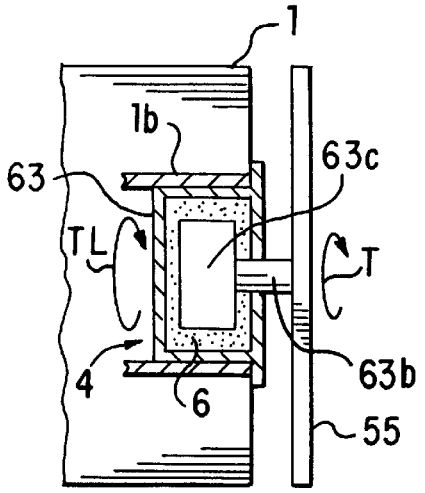
FIG. 9B illustrates a torque limiting device which uses a viscous-elastic material.

In the embodiment of FIG. 9B, the torque limiter 4 is implemented using a viscous-elastic material 6 such as silicon oil contained within the torque limiter 4. Therefore, as the shaft 63 rotates with respect to the inner shaft 63*b* and a member 63*c*, the viscous-elastic material 6 provides a resistance against rotation between the member 63*c* and the shaft 63.

Figure 9C:
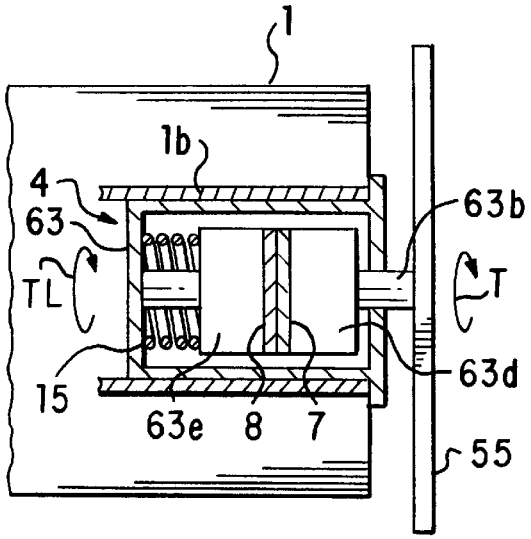
FIG. 9C illustrates a torque limiting device in which two surfaces which are perpendicular to the axis of rotation rub against each other to impose a frictional resistance to rotation.

In the embodiment of FIG. 9C, the rotation resistance is caused due to friction between the friction surfaces 7 and 8 which are pushed against each other by a spring 15. One of the surfaces such as surface 8 may be implemented using plastic or resin and the other surface, such as surface 7 may be implemented using felt or wool, for example. The supporting member 63*d* is fixed to the inner shaft 63*b* which is fixed to the side plate 55. The shaft 63 which contains the torque limiting mechanism 4 has a support surface 63*e* fixed thereto which supports the frictional surface 8. The frictional surfaces 7 and 8 which rotate with respect to each other are perpendicular to an axis of rotation of the shaft 63 and are parallel to each other. The surfaces 7 and 8 are planar although other shapes such as mating convex and concave surfaces can be used. The spring 15 stabilizes rotation by applying a constant force to the support member 63*e* which causes a constant force between the frictional surfaces 7 and 8.

Figure 9D:
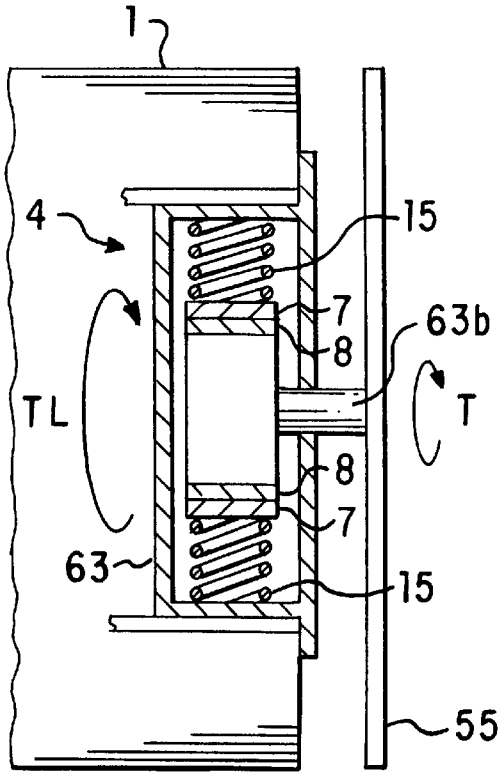
FIG. 9D illustrates a torque limiting device which has two cylindrical surfaces which rub against each other in order to impose resistance against rotating.
Figure 9E:
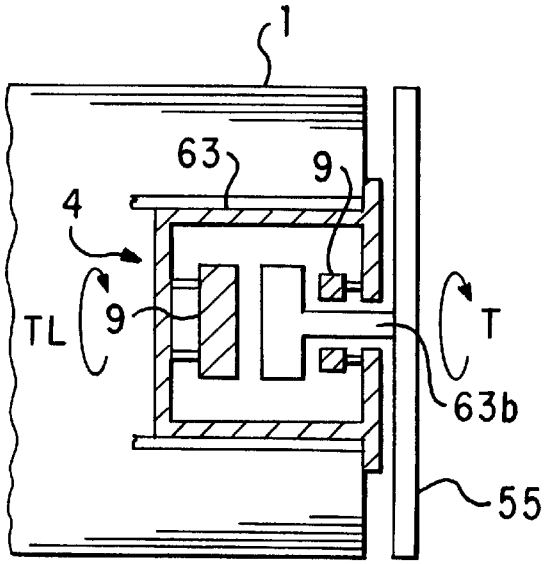
FIG. 9E illustrates a torque limiting device which utilizes magnets to impose a resistance against relative rotation between the support device and the roll of paper.

FIG. 9D illustrates another embodiment of the torque limiter 4 utilized with the present invention in which two cylindrical frictional surfaces 7 and 8 are utilized in the torque limiter 4. These surfaces 7 and 8 are pushed against each other using one or more springs 15. The frictional surface 7 is fixed to the shaft 63 whereas the frictional surface 8 is fixed to the inner shaft 63*b* which is fixed to the side plate 55.

As a further embodiment of the torque limiter, one or more magnets 9 are utilized in the torque limiter 4 and fixed to the shaft 63. A magnet or magnetic material member is fixed to the inner shaft 63*b* which is fixed to the side plate 55. The magnets 9 impart a rotational resistance between the magnets 9 and the inner shaft 63*b* in order to implement the torque limiting function.

Figure 10:
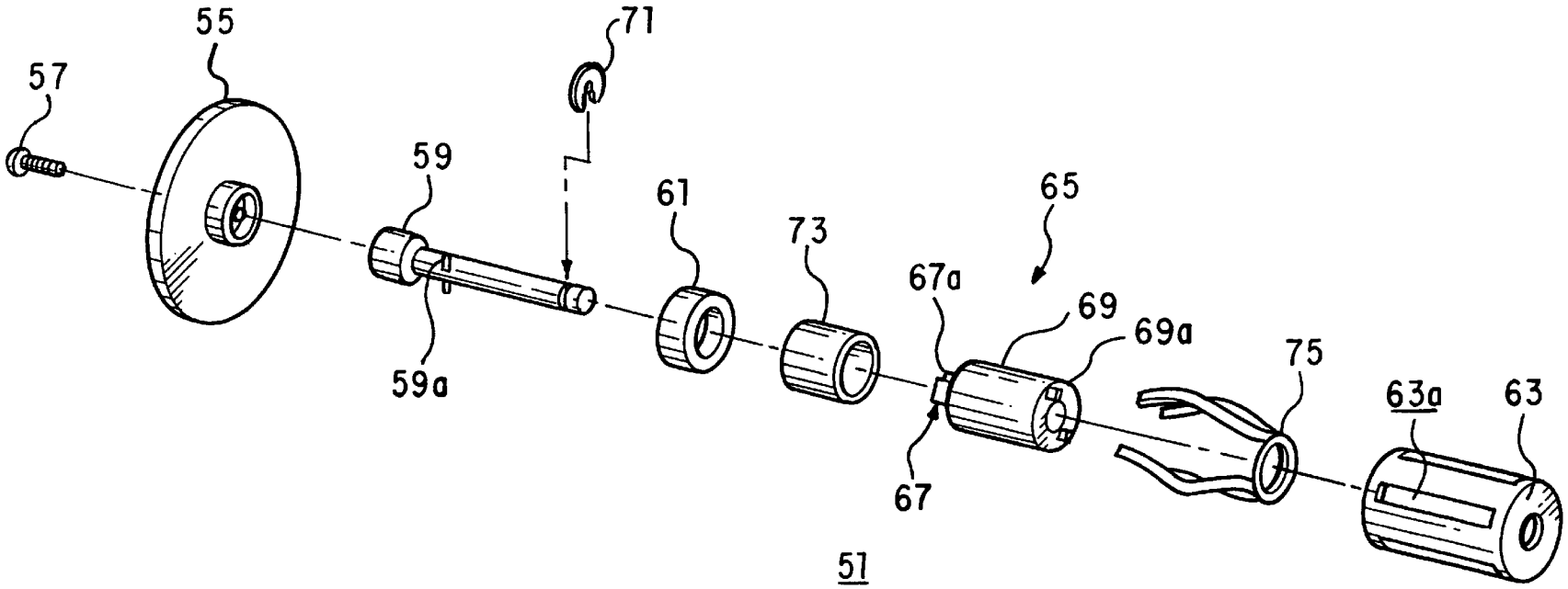
FIG. 10 illustrates an exploded view of a support device constructed in accordance with the present invention.
Figure 11:
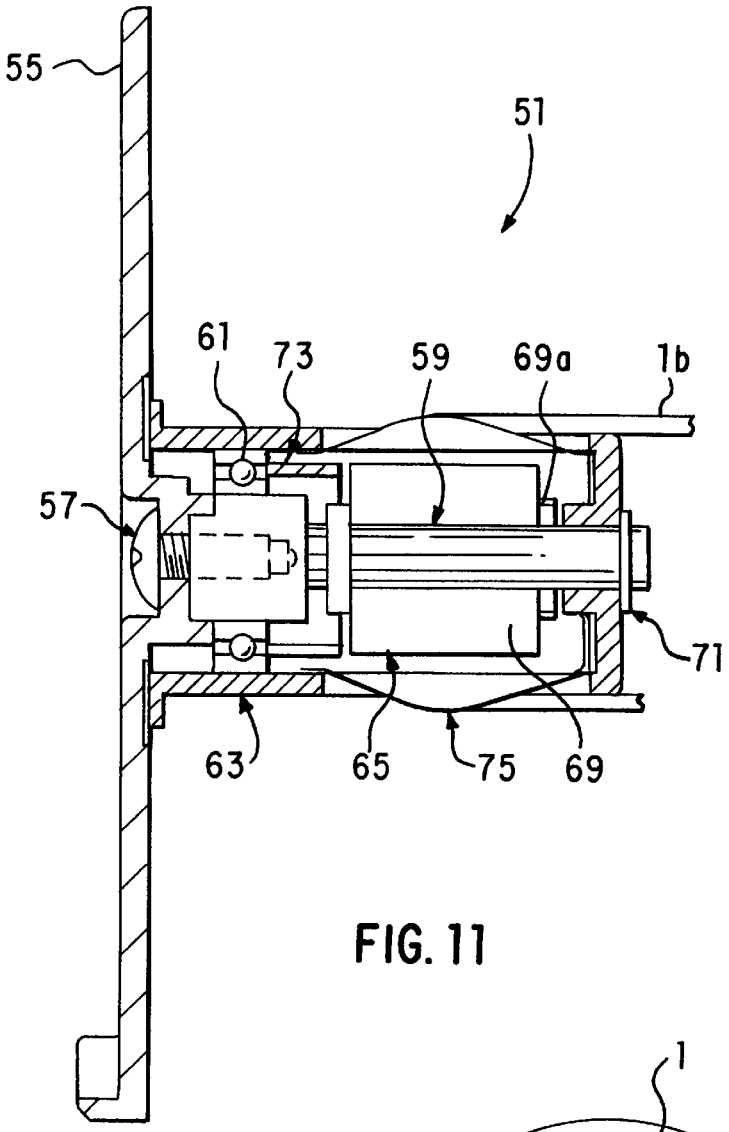
FIG. 11 illustrates a cross-sectional view of the support device of the present invention.

FIGS. 10 and 11 illustrate a construction of the support device or paper spool 51 of a preferred embodiment of the invention. The roll of paper 1 utilizes a support device 51 at each end thereof. The recording paper storage section 10 of FIG. 5 permits the insertion and removal of the roll of recording paper 1 with a paper spool 51 attached to each end thereof. In the present invention, a rotational support device 51 is used at each of the paper roll and preferably, each support device 51 contains a torque limiter. The construction of each of the torque limiters within the support device 51 is preferably performed so that one of the torque limiting devices in one of the support devices provides the appropriate resistance when rotating in one direction, and the other support device 51 must provide the tension Ta against rolling in the other direction as it is reversed as compared to the one support device 51.

The support devices 51, as illustrated in FIGS. 10 and 11 each include a side plate 55. Shaft 59 is fastened to the side plate 55 using a screw 57 and a cover 63 is rotatably attached to the shaft 59 using the bearings 61. The cover 63 is inserted into the tube 1*b* of the roll of paper 1. An E ring or clip 71 is placed over the shaft 59 to prevent the cover 63 from being pulled off of the shaft 59. An inner ring member or first rotational part 67 of the torque limiter 65 (corresponding to torque limiters 4 of FIG. 9A–9E) and pin 59*a* of the shaft 59 are put in a slit 67*a* provided in the inner ring member or first rotational parts 67 so that inner ring member or first rotational part 67 is fixed to the shaft 59 which is fixed to the side plate 55. The torque limiter 65 is fixed to and rotates with the cover 63 by linking projections 69*a* on the housing 69 which mate with cavities (not illustrated) formed on the inner end face of the cover or shaft 63. Further, a collar 73 is provided between the bearings 61 and the torque limiter 65, and one end of each plate spring which is an elastic member and preferably made of metal or plastic 75 is provided between the collar 73 and the cover 63, and the other end of the plate spring 75 is fixed to the inner end face of the cover 63.

The center section of each section or leg of the plate spring 75 projects from the slits 63*a* formed in the cover 63 so that the cover 63 is linked with the inner surface of the tube 1*b* by pressing the plate spring 75 against the inner surface of the tube 1*a*. The side plate 55 is either fixed to the cassette base by friction or by using one or more protruding points which are inserted into corresponding holes or slits in the cassette base. According to the preferred embodiment of the invention, the side plate 55 has the shape illustrated in FIG. 8A in order to provide a simple manner of preventing the side plate 55 from rotating using the flat surface 55*a* illustrated in FIG. 8A.

FIG. 11 illustrates a cross-sectional view of the support device 51 which is illustrated in an exploded view in FIG. 10. As can be seen in FIG. 11, when the support device 51 is assembled, the bearing 61 mates with and goes over the enlarged surface of the shaft 59. Also, the cylindrical collar 73 is used to support the three ends of the plate spring device 75.

Figure 12:
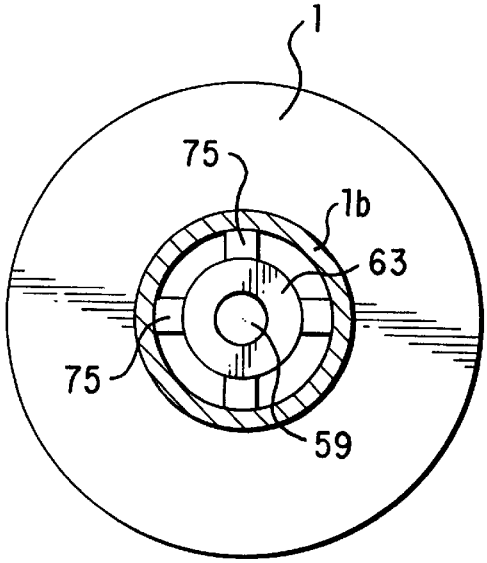
FIG. 12 illustrates a cross-sectional view of the support device of FIGS. 10 and 11 which is along an axis of rotation of the shaft.

FIG. 12 illustrates a cross-sectional view of the roll of paper 1 and cardboard tube 1*b* which is held by the plate springs 75. The plate springs 75 of FIG. 12 correspond to the plate springs 75 utilized in FIGS. 7B, 10 and 11.

Figure 13A:
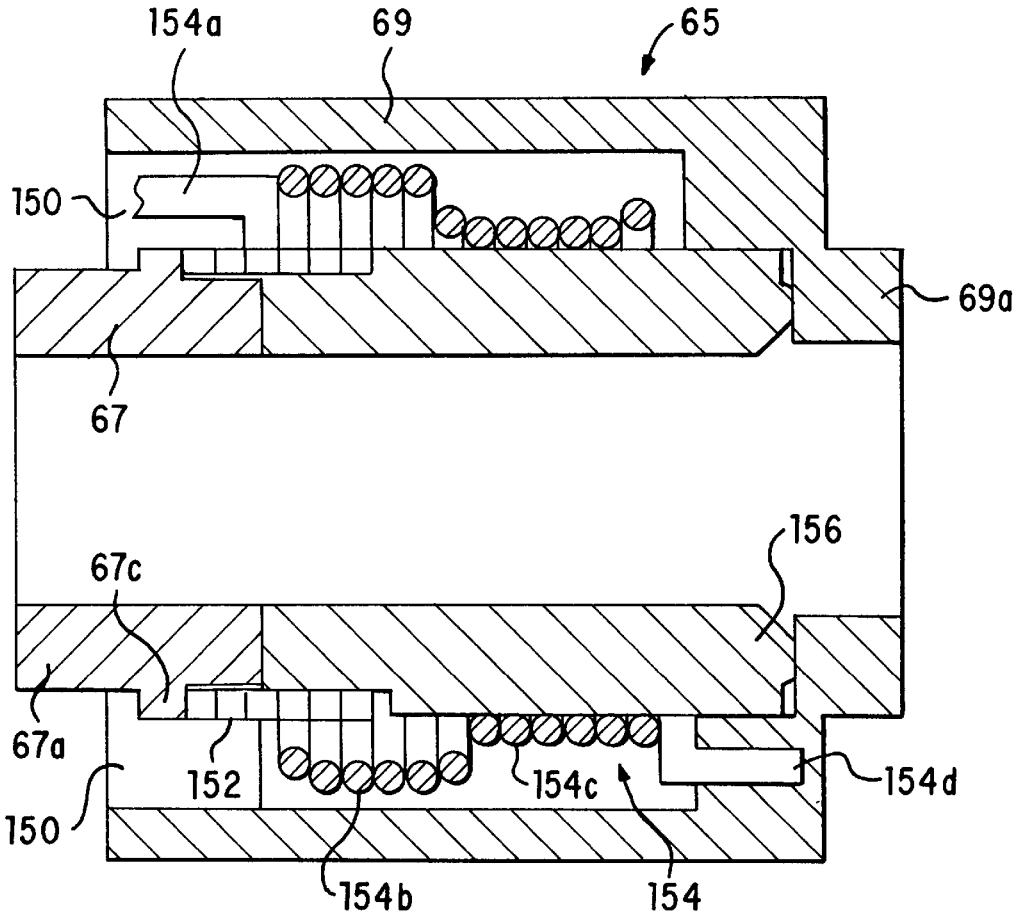
FIG. 13A illustrates a cross-sectional view of a torque limiting device which utilizes two springs.

FIG. 13A is a cross-sectional view of the preferred embodiment of the torque limiter 65 which is implemented using two springs. The torque limiter 65 includes a cylindrical housing 69 which includes the linking projections 69*a* which mate with the inner end face of the cover 63. During manufacture, the components within the cylindrical housing 69 are inserted through an end opposite to the end having the linking projections 69*a*. Within the cylindrical housing 69 are the first rotational member 67 which is a cylindrical ring and a second rotational member 156 which is also a cylindrical ring. Within the cylindrical housing 69, there is a cylindrical spring (also referred to as a first spring) overlapping both the first rotational member 67 and the second rotational member 156. It is not necessary to fix the spring 152 to either of the first or second rotational members because it is fairly tight around the first and/or second rotational members, although the fixing of one or both ends of the spring 152 is possible, if desired. There is also a second spring 154 which is used to link the rotational force of the second rotational member 156 to the cylindrical housing 69. A front cover 150 is used to contain the internal components of the torque limiter 65 which are internal to the cylindrical housing 65. The second spring 154 has a first end 154*a* which is fixed to the front cover 150. A second part 154*b* of the second spring extends over the first spring 152 without contacting the first spring 152. A third part 154*c* of the second spring contacts the second rotational member 156 and a fourth part 154*d* of the spring 154 is fixed to the cylindrical housing 69.

The front cover 150 is fixed to the cylindrical housing 69 in any desired manner such as using glue, a pressure fit, or protrusions and/or indentations which mate with the cylindrical housing 69. The first rotational member 67 which is cylindrical in nature rotates with respect to the front cover 150 and the cylindrical housing 69. The first rotational member 67 is held within the cylindrical housing 69 by a protrusion 67*c* on the first rotational member 67 which the front cover 150 uses to keep the first rotational member 67 in the housing 69. The first rotational member 67 includes linking projections 67*a* between which surround the linking pin 59*a* illustrated in FIG. 10. Through the use of the linking pin 59*a* and the linking projections 67*a*, the first rotational member 67 is rotationally fixed to the shaft 59.

Figure 13B:
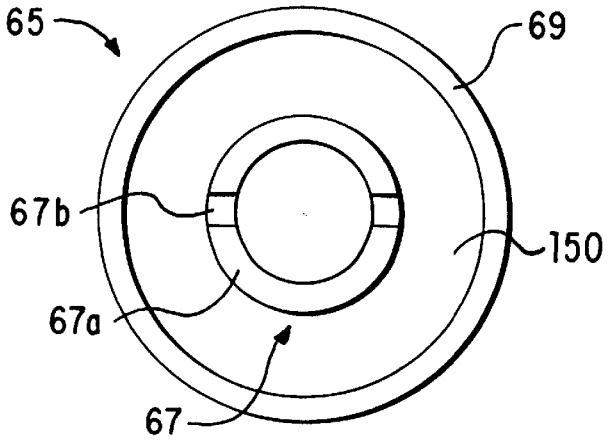
FIG. 13B illustrates a front view of the torque limiting device of FIG. 13A.

FIG. 13B is a view of the torque limiter 65 from the exterior looking towards the front cover 150. The cylindrical housing 69 is seen to be ring-like in nature and has the front cover 150 contained therein. The linking projections 67*a* of the first rotational member 67 and indentation portions 67*b* in which the pin 59*a* resides are also seen. The shaft 59 passes through the center of the torque limiting device 65.

The use of two springs within the torque limiting device 65 allows the torque limiter to impose two different rotational torques, depending on the direction the first rotational member 67 is rotated by the shaft 59 with respect to the cylindrical housing 69 which is rotationally fixed to the outer cover or shaft 63. When the first cylindrical member 67 is rotated in a first direction with respect to the cylindrical housing 69, the second rotational member 156 is prevented from rotating by the spring 154 and therefore is rotationally fixed to the cylindrical housing 69. However, there is a relatively small or light rotational force preventing the first cylindrical member from rotating as the spring 152 holds both the first rotational member 67 and the second rotational member 156. It is to be noted that the friction holding the first rotational member is not due to friction between the first and second rotational members but is due to the spring 152 which holds both of the first rotational member 67 and the second rotational member 156. However, this holding force is not very strong and therefore, the first rotational member 67 is able to rotate fairly easily but with some resistance.

When the first rotational member 67 is rotated in a second direction which is opposite to the first direction, the spring 152 tightens and therefore prevents any type of relative rotation between the first rotational member 67 and the second rotational member 156. Further, the spring 154 tightly contacts the second cylindrical member 156 at portion 154*c* of the spring and the spring 154 is fixed to the cylindrical housing 65 at position 154*d*. Therefore, there is a fairly heavy rotational force or torque required to rotate the first rotational member 67 with respect to the cylindrical housing 69. In the preferred embodiment of the invention, the rotational force or torque imparted by the torque limiter 65 to prevent the paper from pulling out is 160 gram force·cm, although this torque can be any desired value, for example between 100 and 350 gram force·cm. When in a light resistance mode, the torque is preferably between 30 and 50gram force·cm, although this range can be extended to 10 to 100 gram force·cm, for example.

Below is a table which summarizes the operation of the torque limiter 65 illustrated in FIG. 13A and 13B.

| Mode | Light Resistance ≈ 30–50 gram force · cm (first rotational direction) | Heavy Resistance ≈ 160 gram force · cm (second rotational direction) |
|---|---|---|
| Purpose | Provides a light force against rewinding the paper used during slack take up of paper loading process | Provides a force used to decurl the rolled paper |
| First Spring 152 | Lightly locked (allows first rotational member 67 to rotate with respect to the second rotational member 156 in response to light torque) | Completely locked (prevents first rotational member 67 from rotating with respect to the second rotational member 156) |
| Second Spring 154 | Completely locked (prevents second rotational member 156 from rotating with respect to housing 69) | Strongly locked (allows second rotational members 156 to rotate with respect to the cylindrical housing 69 only under a strong torque) |

As can be seen from the above table, during the two different modes of operation, different springs control the force imparted by the torque limiter. In the light resistance mode, it is the spring 152 which controls the rotational force needed to rotate the first rotational member 67 with respect to the housing as the second rotational member 156 does not rotate with respect to the housing due to the spring 154. In the heavy resistance mode of operation, the first spring 152 prevents relative rotation between the first rotational member 67 and the second rotational member 156. Therefore, under the heavy resistance mode of operation, it is the rotational force of the second cylindrical member which is held or resisted by the second spring 154 which controls the amount of resistance imposed by the torque limiter. It is to be noted that the springs can be arranged in any manner as long as the springs function so that one spring controls the rotational force or torque when the first cylindrical member rotates in a first direction and the other spring controls the rotational force or torque when the first cylindrical member rotates in the other direction.

Figure 14:
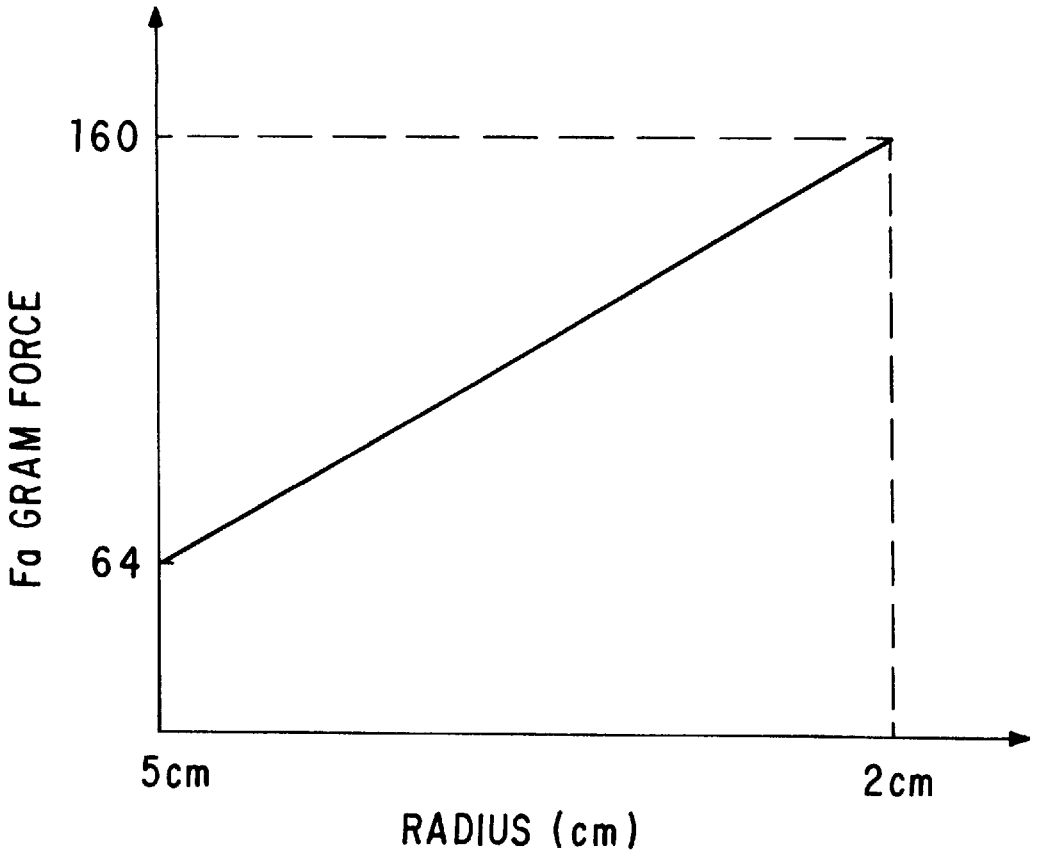
FIG. 14 illustrates the force Fa used to decurl the paper which is achieved by the present invention.

FIG. 14 illustrates the actual force Fa which can be achieved the present invention. In the preferred embodiment of the invention, two torque limiting devices are utilized, one on each end of the roll of paper. Each torque limiter imposes 160 gram force·cm resistance against the feeding out of paper in order to decurl the paper. Therefore, the total torque imposed by the two torque limiters is 320 gram force·cm. As stated above, the radius of the roll of paper has a maximum of 5 cm and a minimum of 2 cm. At 5 cm, the force Fa is equal to 320 gram force·cm divided by 5 cm=64 gram force. When the radius of the roll of paper is reduced to 2 cm, the force Fa is increased to 160 gram force which is equal to 320 gram force·cm/2 cm.

Obviously, numerous modifications and variations of the present invention are possible in light of the above teachings. It is therefore to be understood that within the scope of the appended claims, the invention may be practiced otherwise than as specifically described herein.

What is claimed as new and is desired to be secured by Letters Patent of the United States is:

1. An apparatus for feeding rolled paper, comprising:

a paper support device which rotationally supports a roll of paper;

a torque limiting device, connected to the paper support device, which provides a substantially constant torque which resists a pulling of paper off of the roll of paper;

a pair of rollers which pulls the paper off of the roll of paper; and a roller disposed between the paper support device and the pair of rollers which decurls the paper by wrapping the paper therearound in a direction which is opposite to a direction in which the paper is wound for the roll of paper, wherein:

the torque limiting device further provides a second torque which resists a rolling of paper back onto the roll of paper, the second torque having a different magnitude than a magnitude of the torque which resist the pulling of paper off of the roll of paper.

2. An apparatus according to claim 1, wherein:

the torque limiting device provides the substantially constant force which remains constant as a weight of the roll of paper changes.

3. An apparatus according to claim 1, wherein:

the torque limiting device provides the second torque which has a smaller magnitude than a magnitude of the torque which resists the pulling of paper off the roll of paper.

4. An apparatus according to claim 1, wherein:

the torque limiting device comprises a spring clutch which provides the torque when the paper is pulled off of the roll by gripping a cylindrical member.

5. An apparatus according to claim 1, wherein the paper support device comprises:

a support; and a shaft, connected to the support, which is rotatable relative to the support wherein the torque limiting device is connected to the support and the shaft and limits a torque between the support and the rotatable shaft.

6. An apparatus according to claim 5, wherein:

the torque limiting device is contained in the rotatable shaft.

7. An apparatus according to claim 1, wherein the torque limiting device comprising:

a housing;

a first cylindrical rotatable member contained within the housing having an axis of rotation;

a second cylindrical rotatable member having a same axis of rotation as the axis of rotation of the first rotatable member;

a first spring which connects the first and second cylindrical rotatable members to each other; and a second spring which connects the second cylindrical rotatable member to the housing.

8. An apparatus according to claim 7, wherein:

the first spring controls a torque of the torque limiting device, when the first cylindrical member is rotated in a first direction; and the second spring controls the torque of the torque limiting device which resists a pulling of paper off of the roll of paper, when the first cylindrical member is rotated in a second direction which is opposite to the first direction.

9. An apparatus for feeding rolled paper, comprising:

paper support means which rotationally supports a roll of paper;

torque limiting means connected to the paper support means, which provides a substantially constant torque which resists a pulling of paper off of the roll of paper:

paper pulling means which pulls the paper off of the roll of paper; and a decurling means disposed between the paper support means and the paper pulling means which decurls the paper, wherein:

the torque limiting means further provides a second torque which resists a rolling of paper back onto the roll of paper the second torque having a different magnitude than a magnitude of the torque which resists the pulling of paper off of the roll of paper.

10. An apparatus according to claim 9, wherein:

the torque limiting means provides the substantially constant force which remains constant as a weight of the roll of paper changes.

11. An apparatus according to claim 9, wherein:

the torque limiting means provides the second torque which has a smaller magnitude than a magnitude of the torque which resists the pulling of paper off the roll of paper.

12. An image forming device which uses rolled paper, comprising:

an image forming section which forms electrostatic images on a photoconductive member;

a developing device which develops the electrostatic images into toner images;

a paper support device which rotationally supports a roll of paper;

a torque limiting device, connected to the paper support device, which provides a substantially constant torque which resists a pulling of paper off of the roll of paper;

a pair of rollers which pulls the paper off of the roll of paper;

a roller disposed between the paper support device and the pair of rollers which decurls the paper by wrapping the paper therearound in a direction which is opposite to a direction in which the paper is wound for the roll of paper; and a transfer device which transfers the toner images to the paper, wherein:

the torque limiting device further provides a second torque which resists a rolling of paper back onto the roll of paper, the second torque having a different magnitude than a magnitude of the torque which resists the pulling of paper off of the roll of paper.

13. An apparatus for feeding rolled paper comprising:

a paper support device which rotationally supports a roll of paper;

a torque limiting device, connected to the paper support device, which provides a substantially constant torque which resists a pulling of paper off of the roll of paper;

a pair of rollers which pulls the paper off of the roll of paper; and a roller disposed between the paper support device and the pair of rollers which decurls the paper by wrapping the paper therearound in a direction which is opposite to a direction in which the paper is wound for the roll of paper, wherein the torque limiting device comprising:

a housing;

a first cylindrical rotatable member contained within the housing having an axis of rotation;

a second cylindrical rotatable member having a same axis of rotation as the axis of rotation of the first rotatable member;

a first spring which connects the first and second cylindrical rotatable members to each other; and a second spring which connects the second cylindrical rotatable member to the housing.

14. An apparatus according to claim 13, wherein:

the first spring controls a torque of the torque limiting device, when the first cylindrical member is rotated in a first direction; and the second spring controls the torque of the torque limiting device which resists a pulling of paper off of the roll of paper, ashen the first cylindrical member is rotated in a second direction which is opposite to the first direction.

* * * * *